US005931583A

United States Patent [19]

Collie

[11] Patent Number: 5,931,583

[45] Date of Patent: Aug. 3, 1999

[54] FLEXIBLE INSULATIVE CONTAINER

[76] Inventor: James E. Collie, 934 N. Hamilton, #2, Richmond, Va. 23221

[21] Appl. No.: 08/970,774

[22] Filed: Nov. 14, 1997

Related U.S. Application Data

[60] Provisional application No. 60/030,966, Nov. 15, 1996.

[51] Int. Cl.[6] ..... B65D 30/08; B65D 33/16

[52] U.S. Cl. ..... 383/89; 383/110

[58] Field of Search ..... 383/110, 89, 88

[56] References Cited

U.S. PATENT DOCUMENTS

| | | | |
|---|---|---|---|
| 3,066,846 | 12/1962 | Domigan | 383/89 |
| 4,826,060 | 5/1989 | Hollingsworth | 383/113 |
| 4,854,736 | 8/1989 | McVeigh | 383/110 |
| 5,000,500 | 3/1991 | Almog | 383/89 |
| 5,005,374 | 4/1991 | Spitler | 383/110 |
| 5,354,131 | 10/1994 | Mogil | 383/110 |
| 5,660,476 | 8/1997 | DeCoster | 383/110 |
| 5,743,652 | 4/1998 | Dopps | 383/89 |

FOREIGN PATENT DOCUMENTS

| | | | |
|---|---|---|---|
| 664082 | 6/1965 | Belgium | 383/89 |
| 92053 | 7/1958 | Norway | 383/110 |
| 10642 | of 1908 | United Kingdom | 383/89 |

*Primary Examiner*—Stephen Castellano

*Attorney, Agent, or Firm*—Thomas, Kayden, Horstemeyer & Risley, L.L.P.

[57] ABSTRACT

A pliable, thermally insulative container is provided for maintaining the temperature of the contents inside the container which facilitates the use of ice as a cooling medium. The pliable, thermally insulative container comprises a substantially cylindrical body formed of an exterior shell, an interior liner and flexible insulative material. The body has a top end and a bottom end. The exterior shell and interior liner are attached at the top end creating an interior insulative space between the exterior shell and the interior liner and a storage space lined by the interior liner. In accordance with one aspect of the invention, a waterproof base is attached to the exterior shell at the bottom end of the body sealing the interior insulative space. The flexible, insulative material is disposed within the interior insulative space. The container preferably includes a band at the top end with a quick-release coupling attached thereto for closing the opening at the top end of the container.

13 Claims, 3 Drawing Sheets

FLEXIBLE INSULATIVE CONTAINER

RELATED APPLICATIONS

This application claims priority to U.S. Provisional patent application Ser. No. 60/030,966, filed on Nov. 15, 1996.

FIELD OF THE INVENTION

The present invention relates generally to portable containers for thermally insulating food and/or beverages. More specifically, the present invention relates to a flexible insulative container.

BACKGROUND OF THE INVENTION

Maintaining the temperature of items whose temperatures differ from their environment has always been a challenge. Thermal insulation containers, commonly referred to as "coolers," are frequently used when one cannot use refrigeration units and wishes to keep items cooler than surrounding temperatures. Conventional coolers are commonly made from insulated hard plastic containers having either hinged or fully removable lids. These coolers are typically large and bulky. Additionally, although often waterproof, and therefore useable with ice, conventional coolers are rigid and heavy, rendering them undesirable for transporting or using while engaging in outdoor activities such as biking, hiking, rafting, or kayaking. The interior storage areas of conventional coolers can also be difficult to clean before and after use and are further difficult to dry after use.

In an effort to overcome these drawbacks of conventional coolers, some manufacturers have produced soft coolers. While these soft coolers are pliable and lighter than their conventional predecessors, they typically are not waterproof and are therefore designed to be used with ice substitutes. Conventional ice substitutes come in various forms. An example of one such substitute comprises a sealed package of gel-like material that solidifies when frozen. The sealed package is placed in the cooler with the contents where the ice substitute package keeps the environment within the container cool for a finite period of time. Although providing for a moderate degree of cooling, ice substitutes are not as effective as real ice. First, there is little or no direct contact between the ice substitute and the contents of the cooler. Ice, on the other hand, maintains direct contact with the articles to be cooled thereby providing greater heat transfer. Additionally, upon melting, ice transforms to ice water which remains in direct contact with those contents, providing continued heat transfer. Therefore, the use of an ice substitute results in less heat transfer than that which occurs when ice is used, making ice a more preferable cooling medium.

With the forgoing disadvantages of the prior art in mind, it is an object of the present invention to provide a thermally insulative container for cooling articles that is light, easily portable, pliable and facilitates the use of ice.

It is another object of the present invention to provide such an apparatus that is inexpensive as well as easy to clean and dry.

It is a further object to provide a thermally insulative container designed to easily fit within a secondary carrying apparatus, such as conventional backpacks.

Other objects, features and advantages of the present invention will become apparent upon reading the following specification, when taken in conjunction with the accompanying drawings.

SUMMARY OF THE INVENTION

The present invention relates to a pliable, thermally insulative container useable with ice as a cooling medium for maintaining the temperature of articles within the container, such as food and beverages. The container essentially comprises a body portion defined by a top end and a bottom end. The body portion is formed of a flexible, waterproof interior liner and a flexible, waterproof exterior shell. The interior liner is substantially bag shaped and forms a storage space having an opening at a top end of the body portion. The interior liner and exterior shell are sealed together at the top end of the body portion such that the bag shaped interior liner hangs downwardly from the top end, creating an insulative, interior space between the interior liner and the exterior liner. Disposed within this interior space is a flexible insulative material. In one aspect of the invention, the flexible insulative material extends from the bottom end of the body portion to a point adjacent to the top end, leaving an uninsulated region at the top end of the container which facilitates closure. The container of the invention is flexible such that it is deformable. The container can be easily stuffed into a conventional backpack for use or rolled or folded for storage in minimum space.

In accordance with another aspect of the invention, the container includes a waterproof base that is sealed to the exterior shell at the bottom end of the body portion, closing the interior insulative space. In a preferred embodiment, the container includes a fastener at the top end of the body portion for closing the opening of the storage space. Preferably, the fastener comprises a quick-release coupler having an insertion member and an engaging member being attached to a band such that the insertion and engaging members oppose each other. The band is preferably attached to the body portion at the top end.

In use, ice and objects to be cooled are placed in the storage space through the opening at the top end of the container. Once all the ice and objects desired to be kept cool are placed in the storage space, the opening to the storage space is closed. To do so, the insertion member and the engaging member are first pulled in opposite directions drawing the band taut, closing the opening. Then, the taut band is rolled down, toward the bottom end, over itself, the outer shell, and interior liner, at least twice. After rolling, the insertion member of the quick-release coupler is inserted into the engaging member, fixing the rolled down portion in position. Once closed with the contents inside, the container can be placed in a conventional backpack to be easily transported. After use, the interior liner can be pulled out of the opening of the storage space to quickly and easily clean and dry the interior storage space.

As described above, the flexible insulative container of the present invention provides an apparatus for maintaining the temperature of its contents that is light, easily portable, pliable and facilitates the use of ice for keeping contents cool. In addition, the container of the invention is flexible such that it is deformable. The container can be easily stuffed into a conventional backpack for use or rolled or folded for storage in minimum space.

Other features and advantages of the present invention will become apparent to one with skill in the art upon examination of the following drawings and detailed description. It is intended that all such additional features and advantages be included herein within the scope of the present invention, as defied by the claims.

BRIEF DESCRIPTION OF THE DRAWINGS

The invention can be better understood with reference to the following drawings. The drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Figure 1:
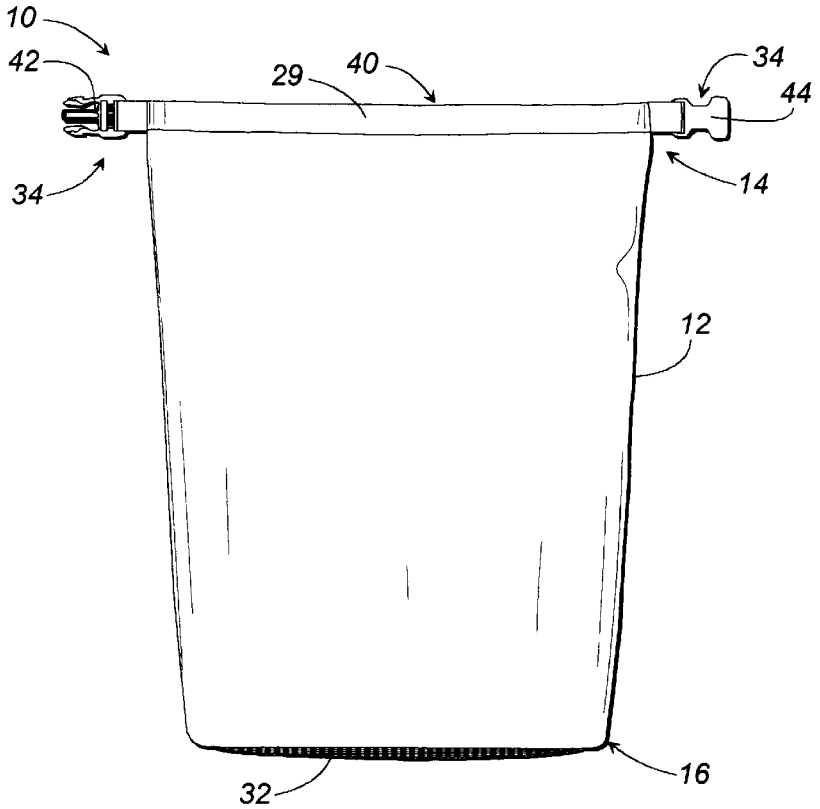
FIG. 1 illustrates a side view of the flexible insulative container of the present invention.
Figure 2:
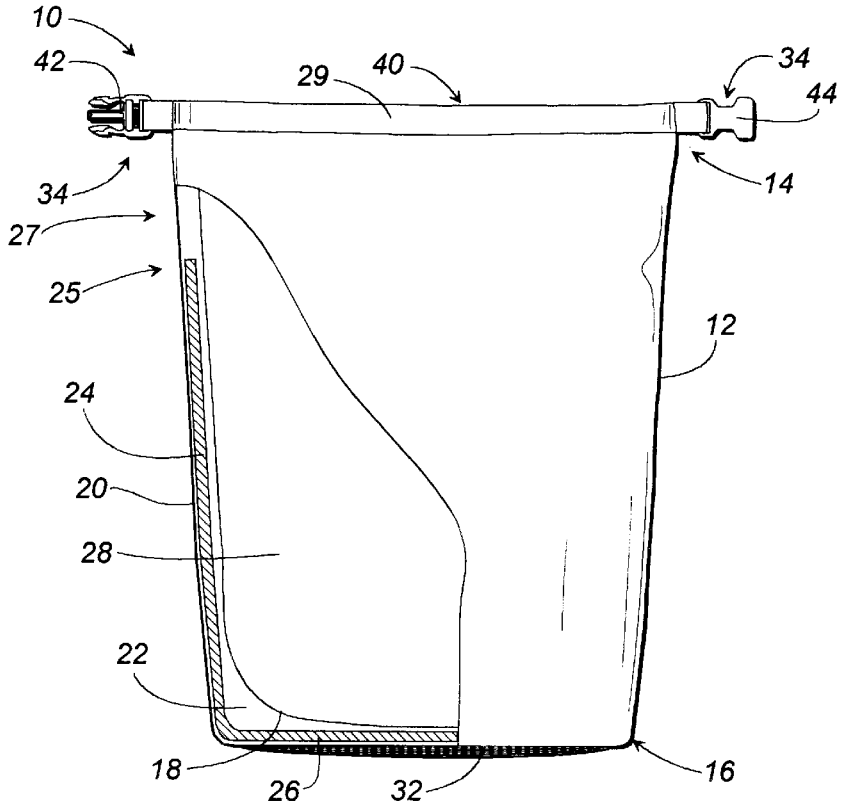
FIG. 2 illustrates a side partial cut-away view of the flexible insulative container.

FIGS. 1 through 7 illustrate the pliable, thermally insulative container 10. Referring to FIGS. 1 and 2, the container 10 is preferably cylindrical and includes a body portion 12 which has a top end 14 and bottom end 16. The body portion 12 is constructed of a flexible, waterproof interior liner 18 and a flexible, waterproof exterior shell 20. The container 12 is preferably constructed of materials deformable in shape, thereby making the container 12 easily stuffed into a secondary carrying apparatus, such as a conventional backpack or the storage area of a kayak, for transportation or rolled or folded for storage. In a preferred embodiment, the waterproof interior liner 18 comprises a heavy gauge vinyl which has been approved by the United States Food and Drug Administration for contact with food and water for human consumption. The waterproof exterior shell 20 comprises vinyl. Although described herein as being formed of particular materials, it will be understood that the interior liner and the exterior shell can be made of other suitable materials.

Figure 3:
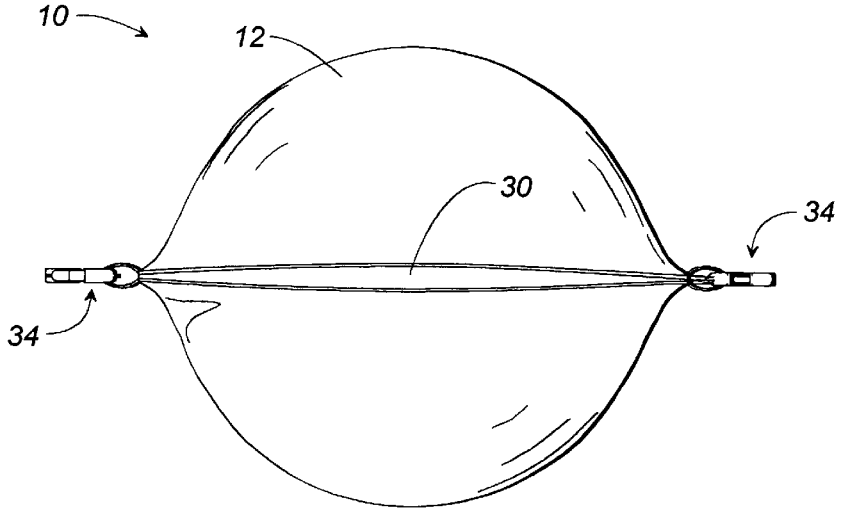
FIG. 3 illustrates a top view of the flexible insulative container.

In a preferred embodiment, the interior liner 18 and the exterior shell 20 are sealed together at the top end 14 of the body portion 12, creating an insulative interior space 22 therebetween and an interior storage space 28, which is lined by the interior liner 18. As shown in FIG. 2, the interior liner 18 is preferably substantially bag shaped such that the interior liner 18 hangs downwardly from the top end 14 of the container 12 toward the bottom end 16 of the container 12. As will be described below, this bag shape facilitates cleaning of the storage space 28 of the container 12. When the container is in use, the interior storage space 28 holds the contents of the container, including the cooling medium and the objects to be cooled. The exterior shell 20 is closed at the bottom end 16 of the body portion 12 enclosing the insulative interior space 22. As shown in FIG. 3, the container 10 has an opening 30 at the top end 14 of the body portion 12 which provides access to the interior storage space 28.

Figure 4:
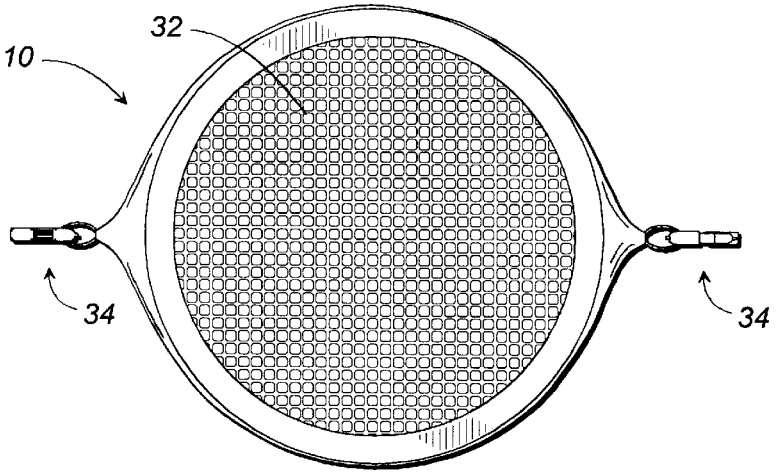
FIG. 4 illustrates a bottom view of the flexible insulative container.

In a preferred embodiment, the flexible insulative container 10 has a waterproof base 32 that is sealed to the exterior shell 20 at the bottom end 16 of the body portion 12, as shown in FIG. 4, and the base 32 is substantially circular in shape. Moreover, the base 32 is substantially planar so that the container 10 can stand upright when placed on a level, flat surface.

Within the interior insulative space 22, flexible insulative material, preferably in the form of a side insulative portion 24 and a bottom insulative portion 26, is placed. Typically, the bottom insulative portion 26 comprises a polyurethane foam disc that is placed between the waterproof base 32 and the interior liner 18. Preferably, the bottom insulative portion 26 is fixed to the waterproof base 32. The side insulative portion 24 typically comprises a rectangular piece of polyurethane foam that is placed between the exterior shell 20 and the interior liner 18 and extends from the bottom end 16 of the body portion 12 to a point 25 adjacent the top end 14 of the body portion 12, leaving an uninsulated region 27 at the top end 14. The uninsulated region 27 facilitates closure of the opening 30. The side insulative portion 24 is preferably fixed to the exterior shell 20. It will be understood that the insulative portions 24 and 26, although described and illustrated as separate pieces and fixedly disposed inside the insulative space 22, could instead be formed of one single piece or be disposed in an unfixed fashion. Furthermore, although polyurethane foam is preferred for the insulative material, a person of ordinary skill in the art will appreciate that the insulative material may comprise one or more other materials.

A fastener 40 is attached to the top end 14 of the body portion 12 for closing the opening 30 of the interior storage space 28. In a preferred embodiment, the fastener 40 comprises a band 29 and a quick-release coupling 34 that comprises an insertion member 42 and an engaging member 44. The insertion member 42 and the engaging member 44 are fixed to the band 29 such that the insertion member 42 and the engaging member 44 are positioned at opposite ends of the top of the container as depicted in FIG. 1. Although the fastener 40 is disclosed as comprising a band 29 and a quick-release coupling 34, it should be appreciated that closure can be accomplished by other means, such as with a channel-lock fastening system 50 (FIG. 7), a hook and loop system 52 (FIG. 6), or the like. While the hook and loop system 52 includes a hook and loop strip 53 and a quick-release coupling 34 and is closed in a similar manner as the band 29 and quick-release coupling 34 embodiment, it is preferable when a channel-lock fastening system 50 is used that the side insulative portion 24 extends from the bottom end 16 to the top end 14 of the container 12 thereby eliminating the uninsulated region 27. So described, the embodiment shown in FIGS. 1 and 2 requires a relatively quick and inexpensive construction process having few steps. Additionally, the construction provides for a substantially waterproof interior storage space 28 allowing ice to be employed as a cooling medium.

To make the tasks of cleaning and drying the interior storage space 28 quick and simple, the interior liner 18 is pulled out of the opening 30 at the top end 14 of the container 10. The interior liner 18 remains sealed to the exterior shell 20 at the top end 14, and the interior liner 18 of the container 10 is effectively turned in-side-out. Since the flexible, insulative material 24 and 26 is preferably fixedly attached to the exterior liner 20 and the waterproof base 32, respectively, the insulative material 24 and 26 remains in place when the interior liner 18 is pulled out of the opening 30.

Figure 5:
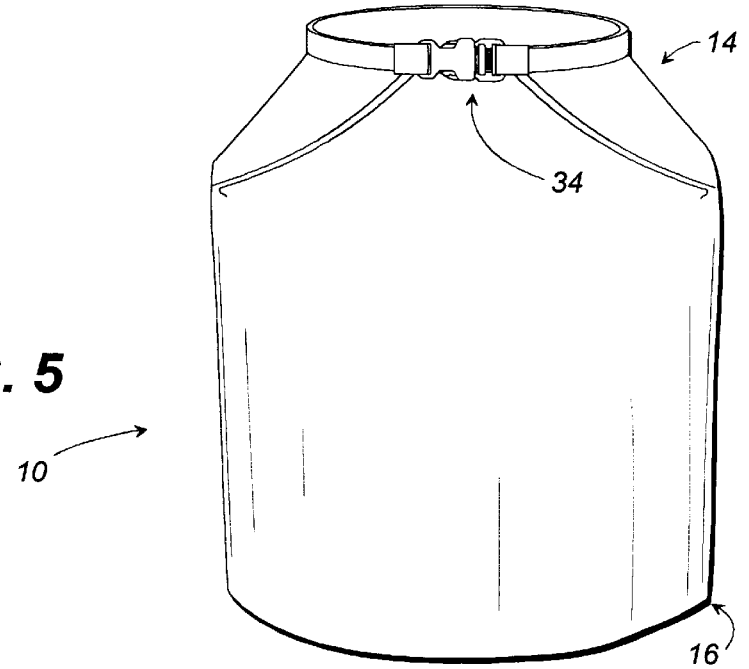
FIG. 5 illustrates a top, side perspective view of the flexible insulative container as closed using a quick-release coupler.
Figure 6:
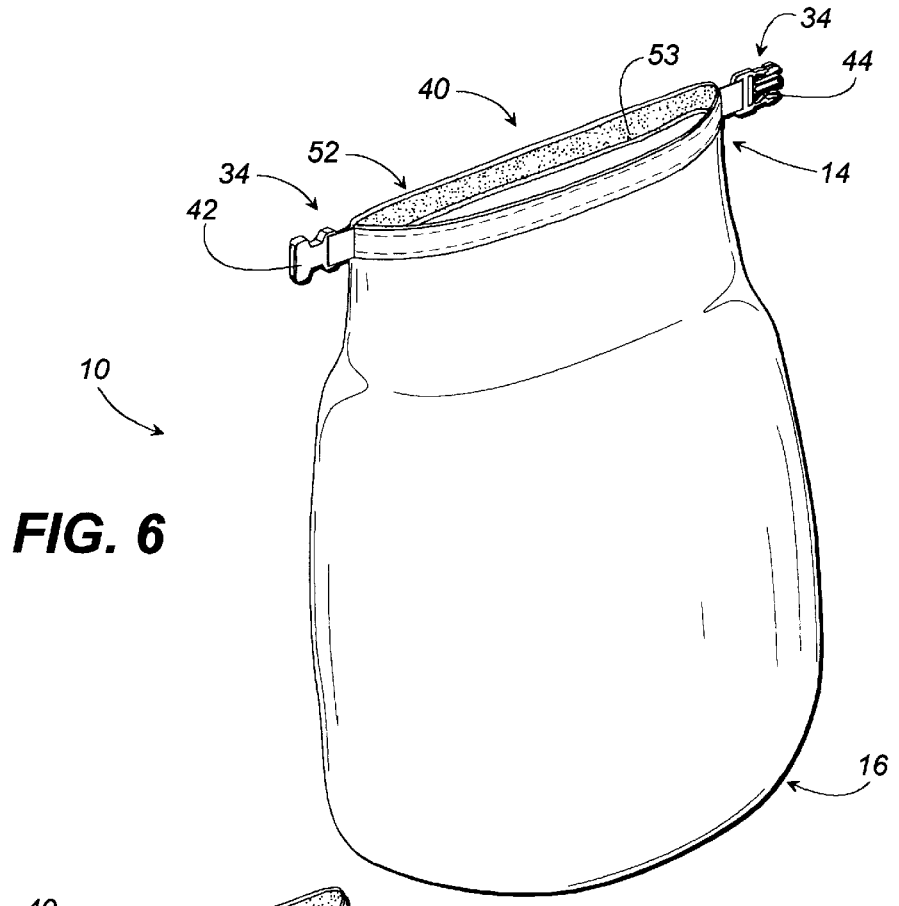
FIG. 6 illustrates a top, side perspective view of the flexible insulative container as provided with a hook and loop fastener and quick-release coupler.
Figure 7:
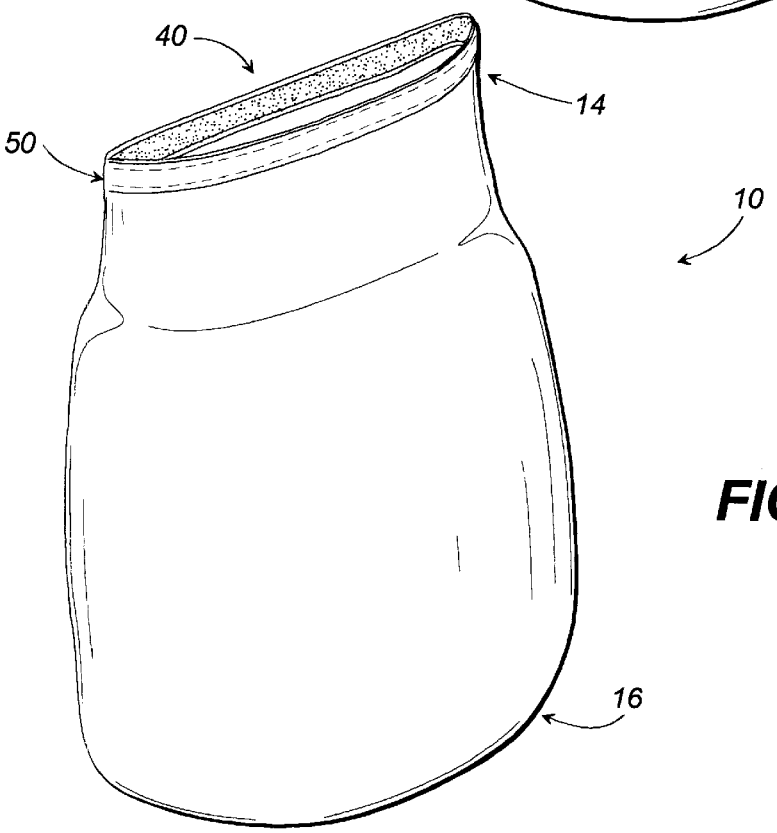
FIG. 7 illustrates a top, side perspective view of the flexible insulative container as provided with a channel-lock fastener.

In use, the opening 30 of the container 10 of the present invention is closed by pulling the insertion member 42 and the engaging member 44 away from each other, thereby drawing the band 29 taut. After pulling the band 29 taut in this manner, the band 29 is rolled downward over itself, the interior liner 18, and the exterior shell 20, towards the bottom end 16. Not including insulative material, the uninsulated region 27 is less bulky and therefore facilitates rolling of the band. After the band 29 is rolled twice, the insertion member 42 is inserted into the engaging member 44 with the engaging member 44 resiliently engaging the insertion member 42 to fix the rolled band 29, interior liner 18, and exterior shell 20 in place and the opening 30 fixedly closed as illustrated in FIG. 5. It should be noted that the opening 30 of the container 10 may be closed using other methods, such as by rolling the taut band 29 down the body portion 12 two or more times. Additionally, other conventional closure systems may be provided such as a channel-lock fastener 50 (FIG. 7) or a hook and loop system 52 (FIG. 6).

The foregoing description has been presented for purposes of illustration and description. It is not intended to be exhaustive or to limit the invention to the precise forms disclosed. Obvious modifications or variations are possible in light of the above teachings. All such modifications and variations are within the scope of the invention as determined by the appended claims when interpreted in accordance with the breadth to which they are fairly and legally entitled.

What is claimed is:

1. A pliable, thermally insulative container for maintaining the temperature of articles stored therein, comprising:

a body portion having a top end, a bottom end, a flexible, waterproof interior liner, and a flexible, waterproof exterior shell, wherein said interior liner and said exterior shell are sealed together at said top end of said body portion forming an interior insulative space therebetween and a storage space that is lined by said interior liner and having an opening at said top end of said body portion;

a waterproof base being sealed to said external shell at said bottom end of said body portion thereby enclosing said interior insulative space;

flexible insulative material disposed within said interior insulative space and being sealed therein; and a roll down quick release closure fixed to said body portion at said top end for closing said opening and said storage space;

wherein said container is substantially waterproof such that ice may be used as a cooling medium within said storage space.

2. The container of claim 1, wherein said waterproof base is substantially circular.

3. The container of claim 1, wherein said waterproof base is substantially planar such that said container can stand upright when placed on said waterproof base on a substantially flat and level surface.

4. The container of claim 1, wherein said roll down quick release closure comprises:

a band fixed to said top end of said body portion; and a quick-release coupling affixed to said band;

wherein said band is pressed together and rolled downwardly over itself and a portion of said body portion and the quick release coupling is fastened to facilitate closure of said storage space and allow ice to be used as a cooling medium within said storage space.

5. The container of claim 4, wherein said quick-release coupling comprises an insertion member and an engaging member wherein said insertion member and said engaging member are affixed to said band at opposite ends thereof and said engaging member releasably engages said insertion member to fixedly close said opening.

6. The container of claim 1, wherein said fastener comprises a hook and loop system including a hook and loop strip attached to said interior liner and a quick-release coupling comprising an insertion member and an engaging member, wherein said insertion member and said engaging member are affixed to said hook and loop strip at opposite ends thereof and said engaging member releasably engages said insertion member to fixedly close said opening.

7. The container of claim 1, wherein said fastener comprises a channel-lock fastener.

8. The container of claim 1, wherein said body portion is substantially cylindrical.

9. The container of claim 1, wherein said flexible insulative material comprises polyurethane foam.

10. The container of claim 1, wherein said flexible insulative material comprises a bottom insulative portion being disposed within said interior insulative space between said waterproof base and said interior liner; and a side insulative portion being disposed within said interior insulative space between said interior liner and said exterior shell and extending from said bottom end of said body to a point adjacent said top end of said body creating an uninsulated region at said top end of said body portion to facilitate closure of said opening;

wherein said bottom insulative portion and said side insulative portion are separate.

11. The container of claim 10, wherein said bottom insulative portion is fixedly attached to said waterproof base and said side insulative portion is fixedly attached to said exterior shell;

wherein said fixed insulative portions facilitate pulling said interior liner out of said container such that said interior liner remains fixed to said container at said top portion and said insulative portions remain fixed.

12. The container of claim 1, wherein said flexible insulative material is fixedly disposed within said interior insulative space, wherein said flexible insulative portions being fixed facilitates removal of said interior liner through said opening of said storage space such that said interior liner remains fixed to said container at said top portion and said insulative portions remain fixed.

13. A pliable, thermally insulative container for maintaining the temperature of contents of the container, comprising:

a substantially cylindrical body portion having a top end and a bottom end, said body portion comprising a flexible, waterproof interior liner bag and a flexible, waterproof exterior shell, wherein said interior liner bag and said exterior shell are sealed together at said top end of said body portion forming an insulative interior space therebetween and a substantially cylindrical storage space that is lined by said interior liner bag and having an opening at said top end of said body portion;

a substantially circular waterproof base sealed to said exterior shell at said bottom end of said body portion so as to enclose said insulative interior space between said interior liner bag and said exterior shell;

a flexible insulative side portion being disposed within said interior insulative space between said interior liner bag and said exterior shell of said body portion, wherein said side portion extends from said bottom end to a point adjacent to said top end creating an uninsulated region at said top end of said body portion to facilitate closure of said opening;

a flexible insulative base portion being disposed within said interior insulative space between said interior liner bag and said waterproof base;

a band fixed to said exterior shell of said body portion at said top end, wherein said band is rolled over itself and said uninsulated region at said top end of said body portion; and a quick-release coupling having an insertion member and an engaging member, wherein said insertion member and said engaging member are affixed to said band at opposite ends thereof, wherein said engaging member resiliently engages said insertion member for fixedly closing said opening;

wherein said closed container is waterproof such that ice may be used as a cooling medium within said storage space.

* * * * *